US005375549A

United States Patent [19]

Hirose

[11] Patent Number: 5,375,549

[45] Date of Patent: Dec. 27, 1994

[54] TRANSPORT VESSEL

[76] Inventor: Tokuzo Hirose, 13-13, Higashiyama-cho, Ashiya-shi, Hyogo, Japan

[21] Appl. No.: 65,887

[22] Filed: May 25, 1993

[30] Foreign Application Priority Data

Feb. 10, 1993 [JP] Japan ..... 5-22802

[51] Int. Cl.[5] ..... B63B 25/08

[52] U.S. Cl. ..... 114/74 R

[58] Field of Search ..... 114/72, 73, 74 A, 74 R, 114/74 T; 220/403, 404, 406, 410, 530, 562, 564, 901

[56] References Cited

U.S. PATENT DOCUMENTS 3,356,251 12/1967 Roberts ..... 114/74 R
4,091,952 5/1978 Capdevielle et al. ..... 220/530
5,031,558 7/1991 Davis ..... 114/74 R

*Primary Examiner*—Edwin Swinehart
*Attorney, Agent, or Firm*—Wenderoth, Lind & Ponack

[57] ABSTRACT

A transport vessel such as a tanker prevents crude oil from spilling in the event of accidents. One or plural storage bags or bladders made of flexible film-like material and having upper entrance and exit openings are installed in one or plural storage chambers of the transport vessel.

4 Claims, 4 Drawing Sheets

TRANSPORT VESSEL

BACKGROUND OF THE INVENTION

1. Field of the Invention

The present invention relates to a transport vessel and more particularly, to a transport vessel that may be used as a tanker.

2. Description of the related art

Accidents involving tankers at sea occur frequently all around the world and cause substantial sea pollution. Particularly, the accident in the Malacca channel is so serious that people who live in coastal countries are apprehensive of its influence. As a result, double-bottomed hull constructions have been developed. However, due to limitations of ship building capacity, it is contemplated that it would take some dozen years or several decades to make all tankers of double-bottom hull construction. Ordinary known tankers have become huge, and the internal storage tank of a tanker has been divided into many parts and constructed to restrict the danger of spills. Nevertheless, a spill such as oil outflow caused by hull destruction in the event of a collision cannot be prevented. Furthermore, in the event that such an oil spill should ignite and cause and explosion, the possibility exists that another oil tank could spill and/or ignite. Even if a tanker is double-bottomed, this does not remove the possibility of an oil spill in the event of a serious accident.

SUMMARY OF THE INVENTION

It is the object of the invention to provide an improved transport vessel which prevents contents from flowing out or spilling in the event of an accident such as a collision.

The invention provides a transport vessel having one or plural storage chambers. A storage bag or bladder having entrance and exit openings and made of flexible film-shaped material is accommodated in each storage chamber.

Plural storage bags may be provided in one storage chamber. The storage bag may be made of plural laminated layers of material. Contents supplied into the storage bag are liquid.

According to the invention, in the event of destruction of an outboard of a hull, the inner storage bag is flexible and therefore is difficult to be broken. Thus, outflow to the sea or the lake of liquid such as crude oil or fluid such as powders stored in the storage bag is prevented.

According to the invention, plural storage bags can be provided in one storage chamber, so that different types of fluids such as liquids can be stored in respective of the bags. For example, it is possible to store liquid such as water and oil in separate and respective bags. Therefore, it becomes possible to export water to oil producing countries that have little water and to import crude oil from such oil producing countries.

According to the invention, in a short time and at a low cost a tanker or other traditional vessel can be improved to be safer than a traditional double-bottomed tanker. It takes substantial time and cost to change a traditional tanker to a double-bottom tanker, but according to the invention such problem can be avoided.

Fresh water or sea water can be supplied into a space between an outside wall of the storage chamber and the storage bag or into a part of plural storage bags, thus preventing high temperatures in the event of accidents, and therefore further improving safety.

According to the invention, because oil is lighter than water, by providing entrance and exit openings at the top of the storage bag, when water is supplied into the storage chamber, such water easily pushes up the storage bag containing oil. An ordinary cargo vessel boat can be remodeled into a tanker extremely easily and it becomes possible to use a cargo vessel both as a cargo vessel and as a tanker. It also is possible to transport fluid different from such as crude oil by providing the storage bag in the storage chamber of the tanker and supplying such as powder into such storage bag.

The film-like material forming the storage bag provides flexibility, oil-tightness and water-tightness. Valves installed at the entrance and exit openings of the storage bag have traditional known construction, and therefore can be provided extremely easily according to the invention. It is possible to produce such storage bags in large quantities in factories other than a dockyard where the vessel is assembled, and a transport vessel according to the invention can be produced by installation of the storage bag in a short time.

BRIEF DESCRIPTION OF THE DRAWINGS

Other and further objects, features and advantages of the invention will be made more explicit from the following detailed description taken with reference to the drawings, wherein.

DETAILED DESCRIPTION OF THE INVENTION

Figure 1:
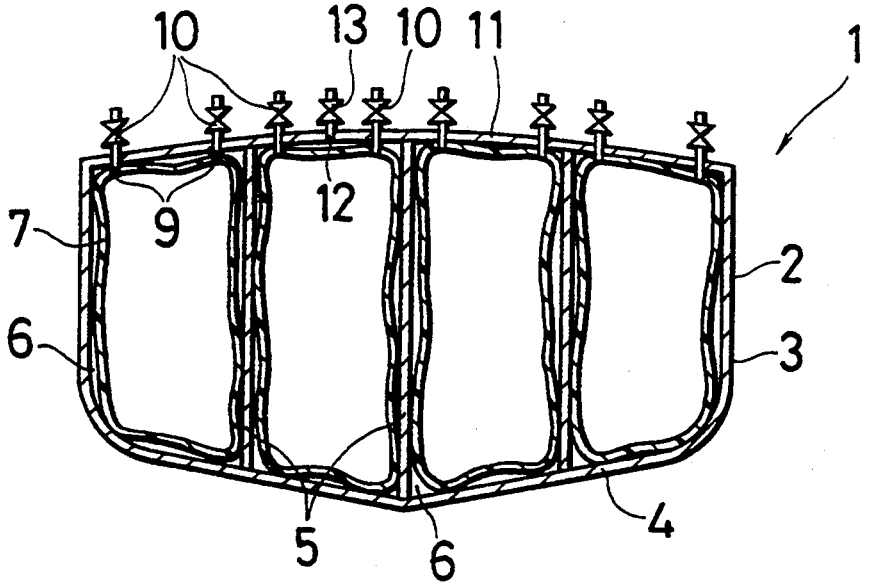
FIG. 1 is a cross sectional view of a transport vessel showing an embodiment of the invention.

Referring now to the drawings, preferred embodiments of the invention are described below.

Figure 2:
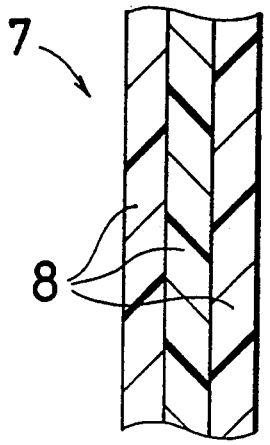
FIG. 2 is a partial sectional view of a storage bag according to the invention.

FIG. 1 is a cross sectional view of a transport vessel showing an embodiment of the invention. A hull 2 of transport vessel 1 has side outboard 3 and bottom outboard 4, and plural holds or storage chambers 6 are formed by partitions 5. Respective storage bladders or bags 7 are provided inside the individual storage chambers 6. The material of the storage bag 7 is constituted by laminating plural individual layers 8 as illustrated in FIG. 2, layers 8 providing oil-tightness, water-tightness, strength, and flexibility. The storage bag 7 of such laminated construction thus is film-like. An air opening with valve 13 is provided to allow flow of atmosphere into and from the storage chamber. Entrance and exit or inlet and outlet openings 9 are provided at the upper part of the storage bag 7, and valves 10 control each such opening. Although the storage bag 7 may be single layer, by providing plural layers as illustrated in FIG. 2, strength is improved and fluid such as liquid container in the bag is prevented from leaking in the event of an accident such as a vessel collision.

Figure 3:
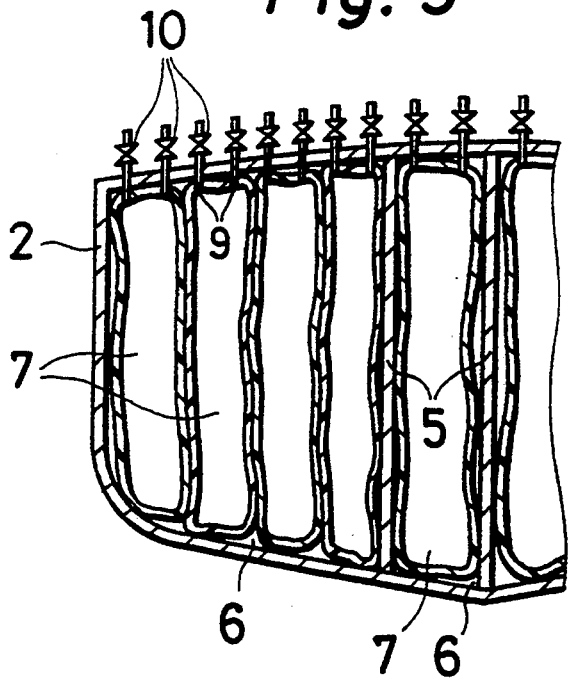
FIG. 3 is a partial sectional view of another embodiment of the invention.

In the embodiment illustrated in FIG. 1, the vessel 2 is formed with plural storage chambers 6 but may have a single storage chamber. FIG. 3 is a partial cross sectional view of another embodiment incorporating the invention and illustrating that plural storage bags 7a may be installed in a single storage chamber 6 or one of plural storage chambers 6.

Figure 4:
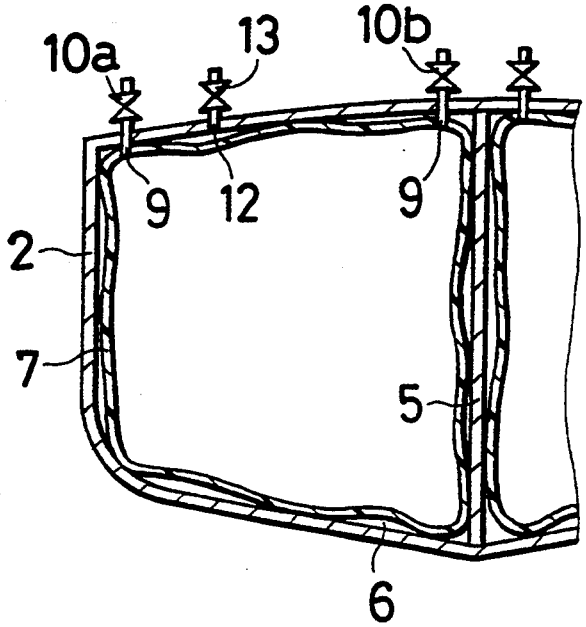
FIG. 4 is a partial sectional view of still another embodiment of the invention.

FIG. 4 illustrates, in an embodiment with one storage bag 7 installed in one storage chamber 6, that when crude oil is supplied into a storage bag 7, entrance valve 10*a* is opened and the crude oil is supplied therethrough while exit valve 10*b* is opened to allow air to be discharged from the bag interior, and the valve 13 is also opened to allow air discharge from the storage chamber. After supply of the crude oil into the storage bag 7, the valves 10*a*, 10*b*, and 13 are closed. When the transport vessel arrives at a port, the valve 10*a* is closed and the valves 10*b* and 13 are opened. The crude oil is withdrawn, e.g. by pumping, through the valve 10*b*. The storage bag bath 7 is collapsed and air is supplied into the storage chamber 6 through the valve 13. Thus, the crude oil is completely withdrawn until the storage bag 7 is completely collapsed.

Figure 5:
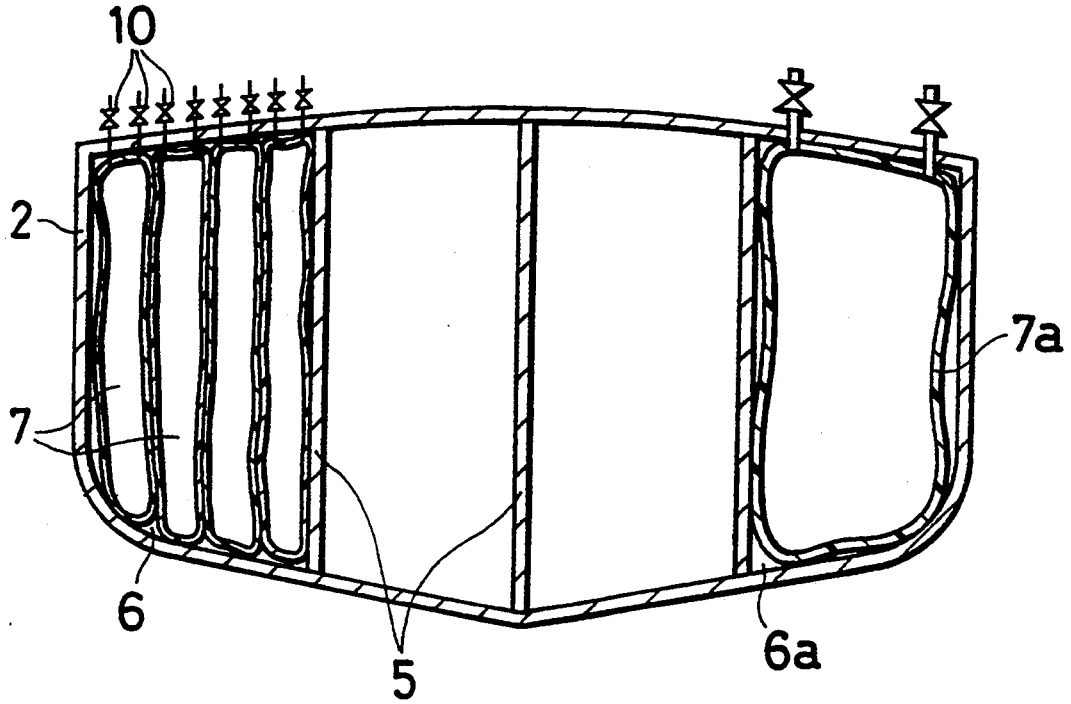
FIG. 5 is a cross sectional view of a still further embodiment of the invention.

FIG. 5 is a cross sectional view of another embodiment incorporating the invention. This embodiment is similar to the previous embodiments, and the same reference numerals are employed as in such embodiments. In this embodiment, plural storage bags 7 are installed in one storage chamber 6 of the hull 2, as described in reference to FIG. 3, and one storage bag 7*a* is installed in one other storage chamber 6*a*. As described above, storage bags 7 and 7*a* are comprised of film-like material of a single layer or of plural layers.

Fresh water or sea water is supplied into the storage chamber 6 around the storage bags 7, or fresh water or sea water is supplied into one or plural storage bags 7. Thereby, the storage bags 7 are protected from high temperature in the event of such an accident.

The entrance and exit openings 9 for the contents and the valves 10 of each storage bag 7, are installed at the top or upper part thereof. Thus, when the contents are materials such as crude oil with a lighter specific gravity than water, the crude oil in the storage bag 7 rise by buoyancy. Therefore, the crude oil easily is exhausted through the exit opening by supplying water having a heavier specific gravity into the storage chamber 6. As shown in FIGS. 1 and 4, in order to make this system possible, a connecting port 12 and the valve 13 are installed in a deck 11 of the hull 2 so that water can be supplied into each storage chamber 6, as described above.

Figure 6:
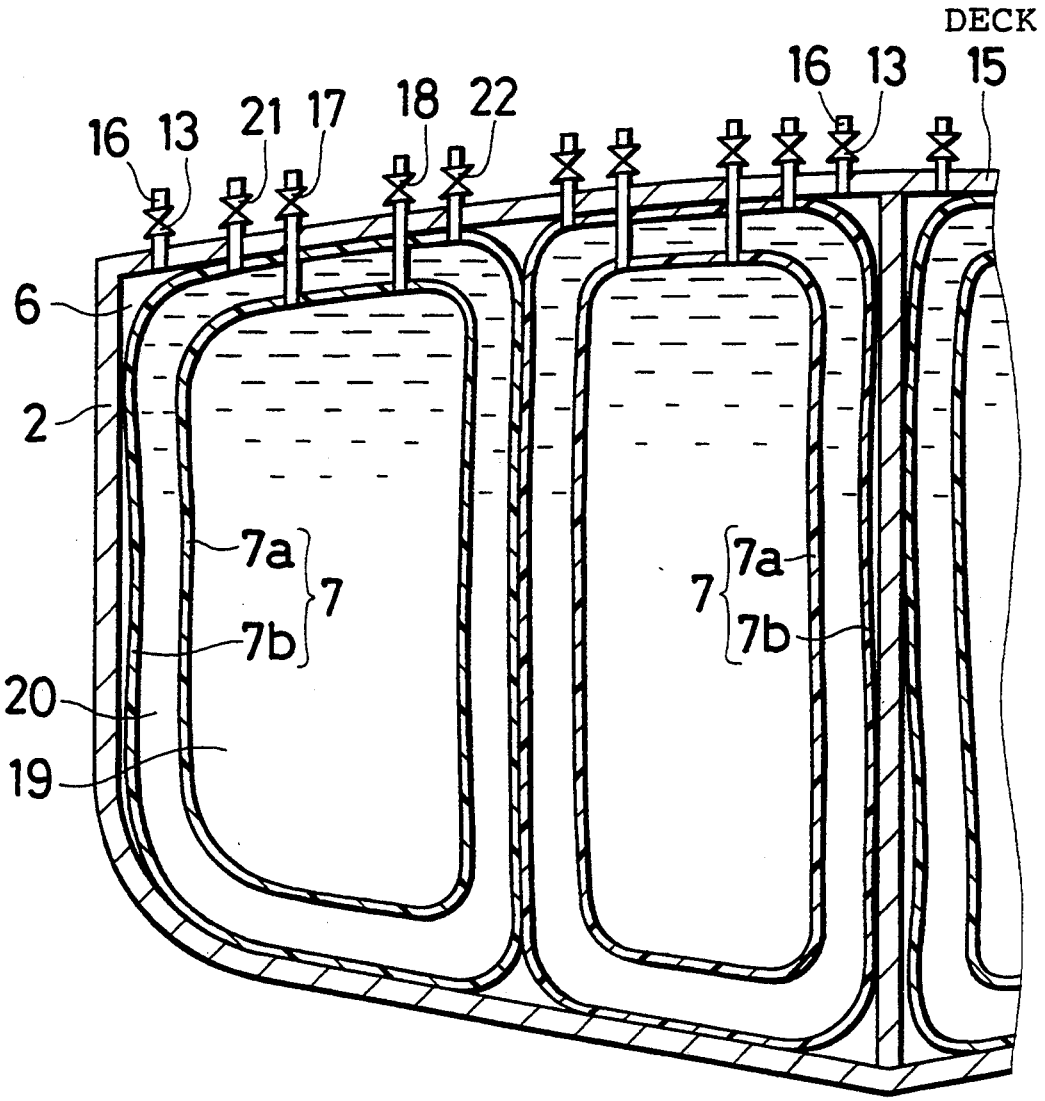
FIG. 6 is a partial cross sectional view of yet another embodiment of the invention.

FIG. 6 is a partial cross sectional view of another embodiment according to the invention. Plural connecting ports 16 with valves 13 are installed in a deck 15 into a storage chamber 6 of the tanker. Plural storage bags 7 are accommodated in the storage chamber 6. Each storage bag 7 includes an inner bag 7*a* and an outer bag 7*b* accommodating the inner bag 7*a*. The inner bag 7*a* and the outer bag 7*b* are airtight and flexible. Crude oil 19 is supplied into the inner bag 7*a* through a valve 17 in upper part of the deck 15, and air in the inner bag 7*a* is discharged through a valve 18. Water 20 is supplied into the space between the outer face of the inner bag 7*a* and inner face of the outer bag 7*b* through a valve 21 in upper part of the deck, and air in such space is discharged through a valve 22. The outer bag 7*b* and water 20 protect the inner bag 7*a*. It thus becomes possible to prevent destruction of the inner bag 7*a* in the event of destruction of the hull 2. The storage bath 7 thus is safe in the event of grounding.

The invention may be embodied in other specific forms without departing from the spirit or essential characteristics thereof. The present embodiments are therefore to e considered in all respects as illustrative and not restrictive, the scope of the invention being indicated by the appended claims rather than by the foregoing description, and all changes which come within the meaning and the range of equivalency of the claims are therefore intended to be embraced therein.

What is claimed is:

1. A transport vessel comprising:

a hull having defined therein a plurality of storage chambers closed upwardly by a deck;

each said storage chamber having therein a plurality of storage bladders, each said storage bladder including an outer bag, an inner bag positioned within and entirely enclosed by said outer bag, and water filling said outer bag and surrounding and protecting said inner bag;

each said outer bag having extending thereinto from said deck a respective valved inlet line and a respective valved outlet line separate from said valved inlet line, thereby enabling water to be supplied into and withdrawn from said each outer bag; and each said inner bag having extending thereinto from said deck a respective valved inlet line and a respective valved outlet line separate from said valved inlet line of said each inner bag, thereby enabling a fluid different from said water to be supplied into and withdrawn from said each inner bag.

2. A vessel as claimed in claim 1, further comprising at least one valved line extending from said deck into each said storage chamber outwardly of the respective said storage bladders, thereby enabling air to be supplied to and withdrawn from said each storage chamber.

3. A vessel as claimed in claim 1, wherein said inner and outer bags are formed of flexible, liquid-tight and air-tight material.

4. A vessel as claimed in claim 3, wherein said material is formed of plural laminated layers.

* * * * *